United States Patent [19]

Nasiatka

[11] Patent Number: 5,054,678

[45] Date of Patent: Oct. 8, 1991

[54] FURNITURE CLIP/TOOL

[75] Inventor: John R. Nasiatka, Northbrook, Ill.

[73] Assignee: Duo-Fast Corporation, Franklin Park, Ill.

[21] Appl. No.: 380,903

[22] Filed: Jul. 17, 1989

[51] Int. Cl.[5] ..... B25C 7/00

[52] U.S. Cl. ..... 227/8; 227/120; 227/148

[58] Field of Search ..... 227/8, 120, 148

[56] References Cited

U.S. PATENT DOCUMENTS

| | | | |
|---|---|---|---|
| 2,946,060 | 7/1960 | Powers . | |
| 3,360,116 | 12/1967 | Gehl et al. | 227/148 |
| 3,496,840 | 2/1970 | Wandel et al. | 92/85 |
| 3,633,810 | 1/1972 | Krakauter et al. | 227/120 X |
| 3,673,922 | 7/1972 | Doyle | 91/422 |
| 3,693,863 | 9/1972 | Black | 227/148 X |
| 4,073,423 | 2/1978 | Omley | 227/70 |
| 4,224,831 | 9/1980 | Lingle | 29/432 |
| 4,485,952 | 12/1984 | Weis | 227/7 |

FOREIGN PATENT DOCUMENTS

| | | | |
|---|---|---|---|
| 2511319 | 9/1976 | Fed. Rep. of Germany | 227/148 |
| 3402298 | 7/1985 | Fed. Rep. of Germany | 227/148 |

*Primary Examiner*—Paul A. Bell

[57] ABSTRACT

A fastener driving tool includes a guide for positioning a furniture spring clip with respect to the tool and also positions the furniture spring clip with respect to a wooden furniture frame to allow the furniture spring clip to be secured thereto. A furniture spring clip is also disclosed which includes one or more fastener receiving apertures which allow the fastener to be received in the wooden frame at a corner at approximately a 45° angle with respect to adjacent perpendicular surfaces of the furniture frame. The furniture spring clip is thus adapted to be secured to a wooden furniture frame with a single fastener which provides holding power along two axes with respect to adjacent perpendicular surfaces of the wooden furniture frame.

9 Claims, 4 Drawing Sheets

Fig. 1
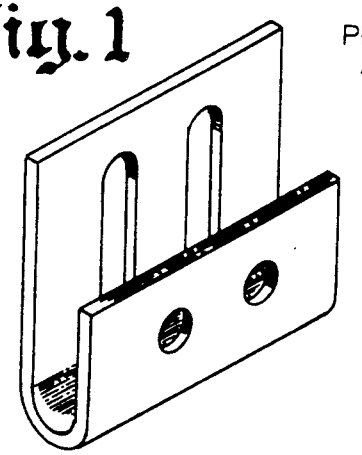
Fig. 3
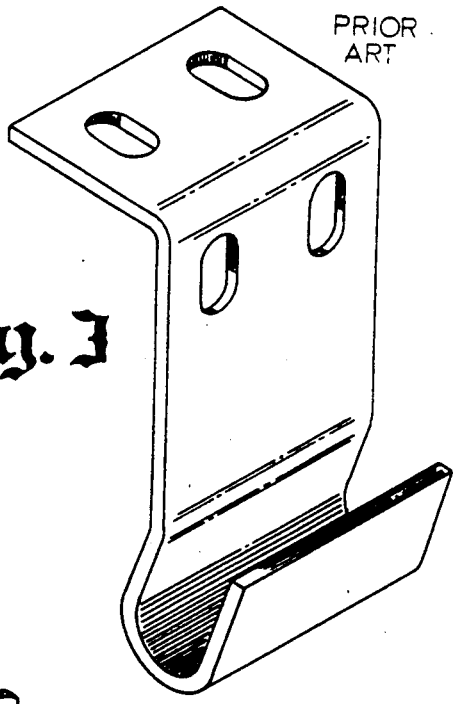
Fig. 2
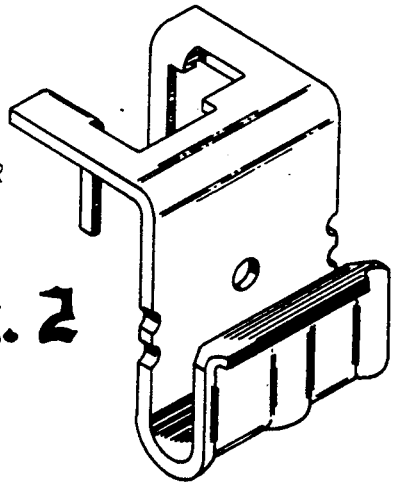
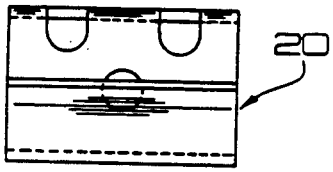
Fig. 6
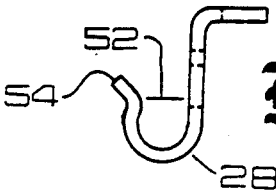
Fig. 7
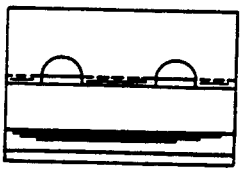
Fig. 5
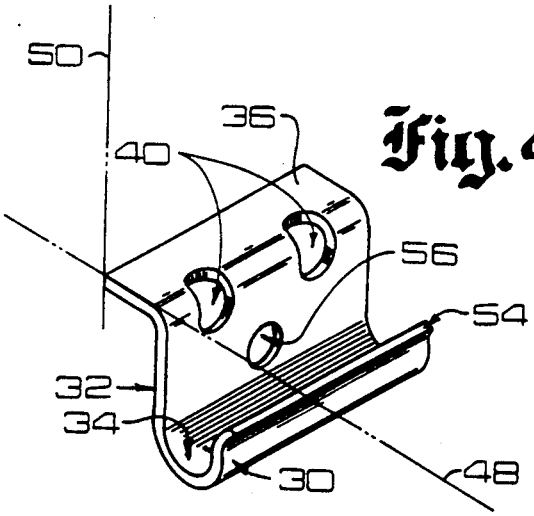
Fig. 4

Fig. 12
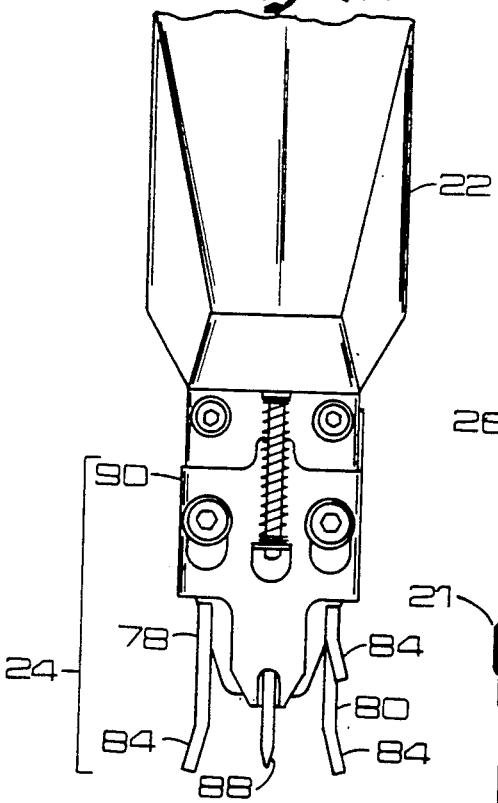
Fig. 13
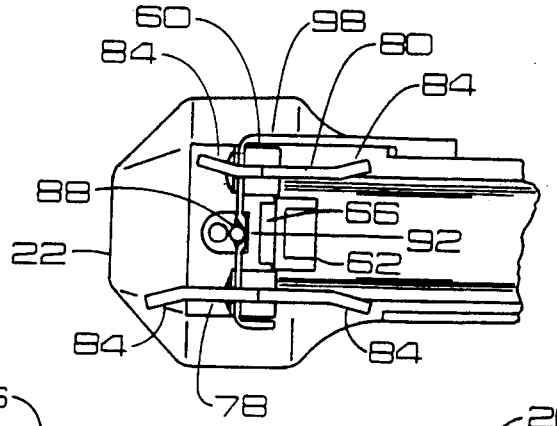
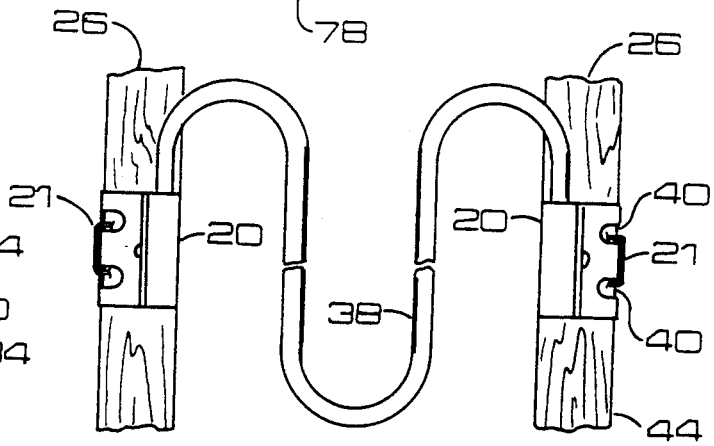
Fig. 8
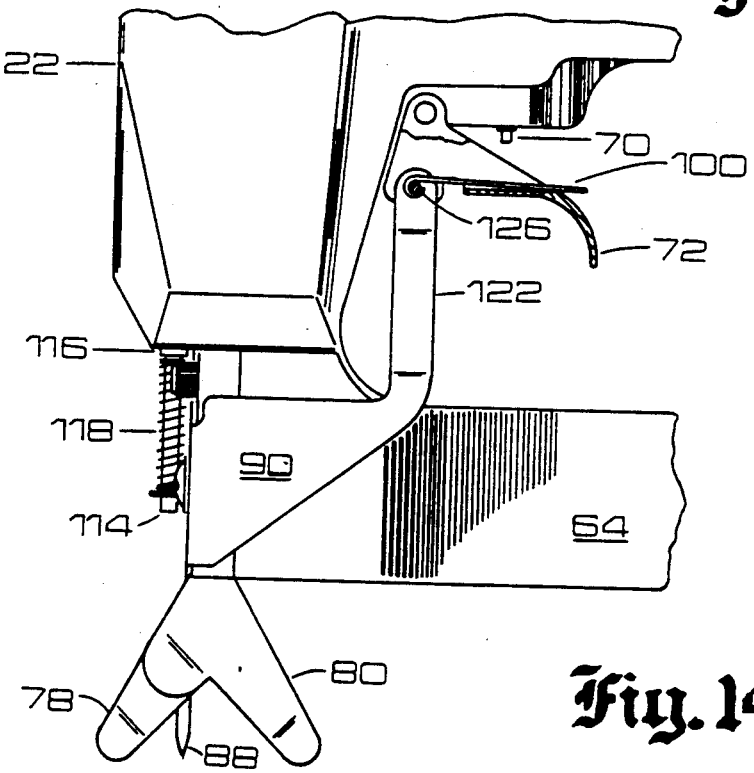
Fig. 14

Fig. 10
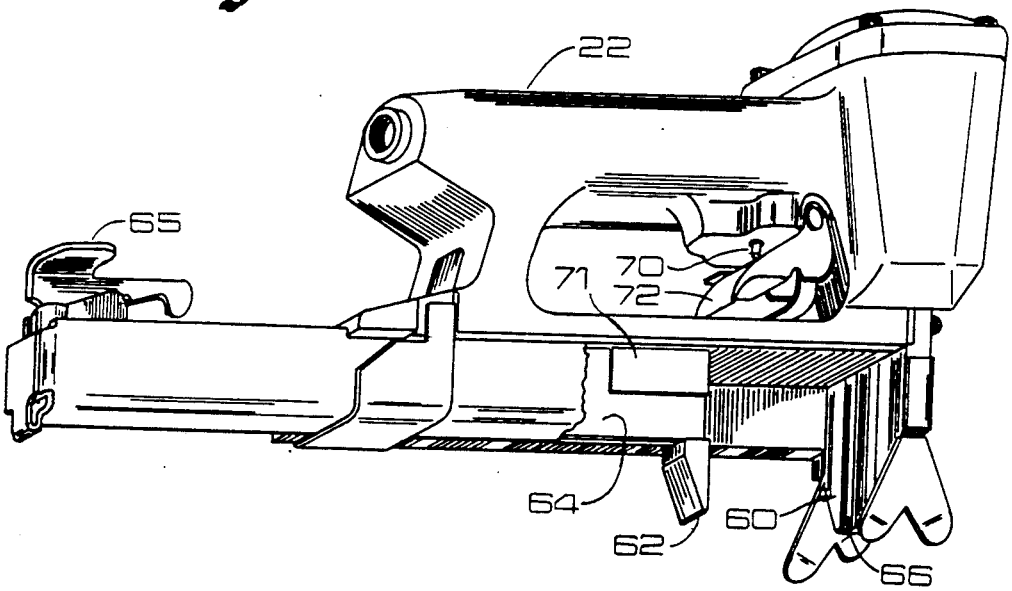
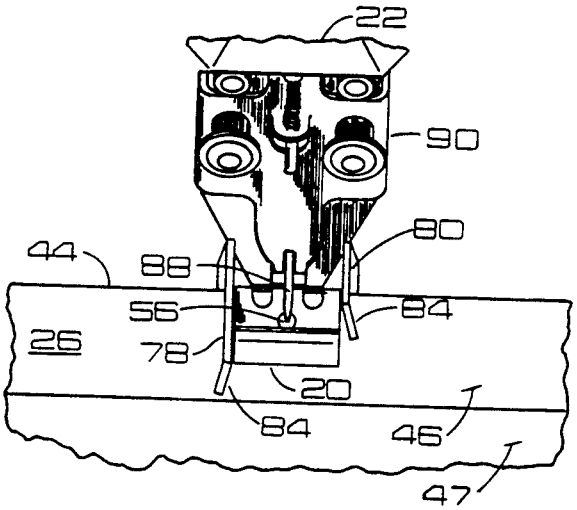
Fig. 11
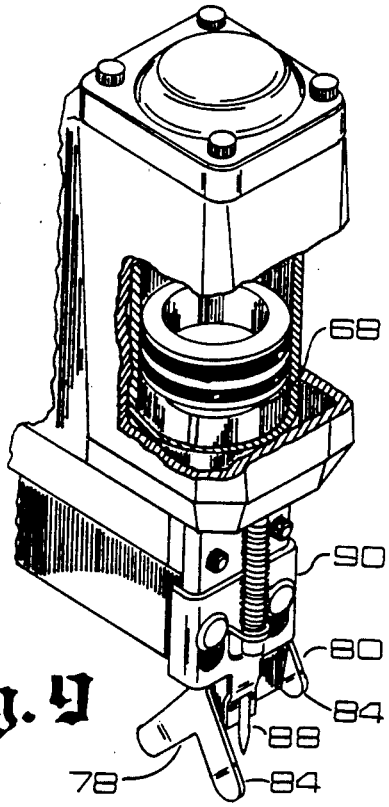
Fig. 9

FURNITURE CLIP/TOOLcl CROSS REFERENCE TO RELATED APPLICATIONS

This application relates generally to a fastener driving tool which includes a guide for positioning the tool with respect to a furniture spring clip. U.S. patent application Ser. No. 07/367,787, filed on June 19, 1989, now U.S. Pat. No. 5,025,968 also assigned to the same assignee as the present invention, also relates to a fastener driving tool having a guide for positioning the tool with respect to a furniture clip.

BACKGROUND OF THE INVENTION

1. Field of the Invention

This invention relates to a fastener driving tool and, more particularly to a fastener driving tool for securing furniture spring clips to a wooden furniture frame which includes a guide for positioning the tool with respect to the furniture frame and which also positions the furniture spring clip with respect to the tool. The invention also relates to a furniture spring clip having fastener receiving apertures, located to allow one or more fasteners to be driven into the wooden furniture rail at about a 45° angle.

2. Description of the Prior Art

Fastener driving tools for securing a furniture spring clip to a wooden furniture frame are known in the art. Examples of such tools are disclosed in Powers U.S. Pat. No. 2,946,060; Lingle U.S. Pat. No. 4,224,731 and Weis U.S. Pat. No. 4,485,952. The Powers and Weis patents disclose fastener driving tools which include a guide for use with a so-called J-type furniture spring clip, illustrated in FIG. 1, which positions the furniture spring clip with respect to the tool. However, neither of these patents disclose a fastener driving tool for securing a furniture spring clip to a wooden furniture frame which additionally positions the furniture spring clip with respect to the wood furniture frame. With such tools, it is necessary for the operator to position the furniture spring clip with respect to the wood furniture frame, which can be cumbersome. Moreover, the guides included with the fastener driving tools disclosed in the Weis and Powers patents are only adapted to be used with J-type furniture clips.

The Lingle patent discloses an assembly line type machine for attaching furniture spring clips to wooden furniture rails. The Lingle apparatus also includes means for positioning the furniture spring clips with respect to the wood furniture rails. However, the Lingle apparatus is not a portable device and is rather expensive.

A fastener driving tool for attaching J-type furniture spring clips to a wooden furniture frame is also disclosed in copending application Ser. No. 07/367,787, filed on June 19, 1989, assigned to the same assignee of the present invention. The fastener driving tool disclosed in this application includes a guide for positioning a J-type furniture clip with respect to the tool. It does not disclose means for positioning the furniture clip with respect to the wooden furniture frame.

Various furniture spring clips have been used to attach furniture springs to a wooden furniture frame, as illustrated in FIGS. 1–3. The furniture spring clip illustrated in FIG. 1 is known as a "J-type" furniture spring clip. With this type of clip, a staple is received in slots provided in one leg of the clip. One end of the furniture spring is then placed into the bight portion. Subsequently, a second staple is driven through the apertures in the short leg and subsequently through the slots. The second staple bends the short leg around the furniture clip. With this type of furniture clip, the staples are received at approximately a 90° angle with respect to the surface of the wooden furniture frame.

FIG. 2 illustrates what is known as a Hartco furniture clip named after the company that manufactures such clips. This type of clip is disclosed in Lingle U.S. Pat. No. 4,224,731. This clip includes an L-shaped portion and a J-shaped portion. The short leg of the L-shaped portion is formed with two downwardly extending spikes for attaching the furniture spring clip to the wooden furniture frame. One end of the spring is received in the bight of the J-portion of the clip. The downwardly extending spikes are driven into the wooden furniture frame at approximately a 90° angle with respect to the furniture frame surface.

With both the J-type and Hartco furniture spring clips, the furniture clip is secured to the wooden furniture frame generally perpendicular to one surface of the furniture frame. Consequently, the fasteners provide a holding force only along one axis.

Another furniture spring clip is illustrated in FIG. 3. This type of furniture spring clip is provided with an elongated leg to allow the spring to be positioned away from the wooden furniture frame. This type of furniture spring clip is provided with two pairs of staple receiving apertures. This allows the fasteners to provide a holding force along two axes and consequently more securely attaches the furniture spring clip to the wooden furniture frame. However, such a furniture spring clip requires two fasteners which can increase the labor time and cost to attach the furniture spring clip to the furniture frame.

SUMMARY OF THE INVENTION

It is an object of the present invention to provide a fastener driving tool for attaching furniture spring clips to a wooden furniture frame which overcomes the problems associated with the prior art.

It is another object of the present invention to provide a furniture spring clip for receiving a single fastener which provides holding power along two axes with respect to the wooden furniture frame.

Briefly, the present invention relates to a fastener driving tool which includes a guide for positioning a furniture spring clip with respect to the tool and also positions the furniture spring clip with respect to a wooden furniture frame to allow it to be secured thereto. A furniture spring clip is also disclosed which includes a one or more fastener receiving apertures which allow the fastener to be received in the wooden frame at a corner at approximately at a 45° angle with respect to adjacent perpendicular surfaces of the furniture frame. The furniture spring clip is thus adapted to be secured to a wooden furniture frame with a single fastener which provides holding power along two axes with respect to adjacent perpendicular surfaces of the wooden furniture frame.

DESCRIPTION OF THE DRAWING

These and other objects and advantages of the present invention will become readily apparent upon consideration of the following detailed description and attached drawing, wherein:

FIG. 1 is a perspective view of a prior art, J-type furniture clip;

FIG. 2 is a perspective view of another prior art furniture spring clip, known as a Hartco type clip;

FIG. 3 is a third type of prior art furniture spring clip;

FIG. 4 is a perspective view of a furniture spring clip in accordance with the present invention;

FIG. 5 is a top plan view of the furniture spring clip of FIG. 4;

FIG. 6 is a front elevational view of the furniture spring clip of FIG. 4;

FIG. 7 is a side elevational view of the furniture spring clip of FIG. 4;

FIG. 8 is a plan view, broken away, illustrating a furniture spring clip secured to a wooden furniture frame including a furniture spring;

FIG. 9 is a partial perspective view of a fastener driving tool including the furniture spring clip guide in accordance with the present invention, partially broken away illustrating a drive piston;

FIG. 10 is a perspective view of a fastener driving tool incorporating the furniture spring clip guide in accordance with the present invention partially broken away, illustrating a magazine assembly;

FIG. 11 is a partial plan view of the fastener driving tool incorporating the furniture spring clip guide and the furniture spring clip in accordance with the present invention illustrating a portion of a wooden furniture frame;

FIG. 12 is a partial front elevational view of a fastener driving tool including the furniture spring clip guide in accordance with the present invention;

FIG. 13 is a partial bottom plan view of a fastener driving tool incorporating a furniture spring clip guide in accordance with the present invention;

FIG. 14 is a partial side elevational view of a fastener driving tool incorporating the furniture spring clip guide in accordance with the present invention shown with the safety yoke in the down position;

DETAILED DESCRIPTION

Figure 15:
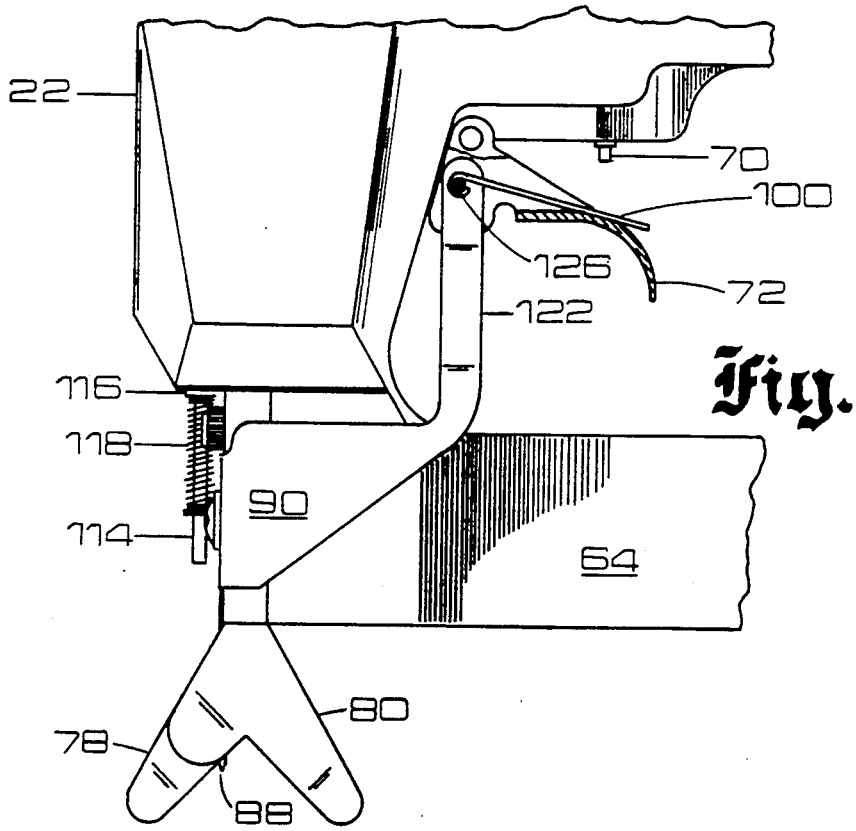
FIG. 15 is similar to FIG. 14 shown with the safety yoke in the up position.

There are two aspects of the present invention. One aspect relates to a furniture spring clip, generally identified by the reference numeral 20, adapted to be secured to a wooden furniture frame 26 with a single fastener 21, such as a staple, at approximately a 45° angle with respect to the top surface of the wooden furniture frame 26. The other aspect of the invention relates to a fastener driving tool 22 with a furniture spring clip guide assembly 24 which not only positions the furniture spring clip 20 with respect to the fastener driving tool 22 but also positions the fastener driving tool 22 with respect to a wooden furniture frame 26.

The furniture spring clip 20 in accordance with the present invention is best illustrated in FIGS. 4–7. The furniture spring clip 20 is generally J-shaped having a short leg 30, a relatively longer leg 32 and a bight portion 34. A portion of the long leg 32 is formed to be generally perpendicular to the long leg 32 defining a ledge portion 36. The 90° angle formed by the ledge portion 36 and the long leg 32 is adapted to be seated on the corner of a wooden furniture frame 26. As shown in FIG. 8, the furniture spring clips 20 are disposed on spaced apart wooden furniture frame members and carry opposite ends of a furniture spring 38 to allow the furniture spring 38 to be suspended across the furniture frame 26.

An important aspect of the furniture spring clip 20 in accordance with the present invention is the position of the fastener receiving apertures 40. The fastener receiving apertures 40 allow a fastener, such as a staple 21, to be driven into a corner 44 of the wooden furniture frame 26 at roughly a 45° angle with respect to the adjacent surfaces 46 and 47 of the wooden furniture frame 26. By driving a staple 21 into the corner 44 of the wooden furniture frame 26 the holding force securing the furniture spring clip 20 to the wooden furniture frame 26 is applied along two axes 48 and 50 (FIG. 4) with a single staple 21. The axis 50 is generally parallel to the long leg 32 while the axis 48 is generally perpendicular to the axis 50. By providing holding power along two axes 48 and 50, smaller staples and consequently smaller fastener driving tools can be used to secure the furniture spring clips 20 to the wooden furniture frame 26. For example, known fastener driving tools for securing a furniture spring clip, such as a J-type spring clip (FIG. 1), to a furniture frame 26 utilize 16 gauge $\frac{3}{4}''$ long staples. By driving the staple 21 into the corner 44, a relatively smaller staple 21 can be used and consequently, a relatively smaller tool 22 and resulting in the same or superior holding power. For example, an 18 gauge $\frac{5}{8}''$ long staple may be used. Moreover, the furniture spring clip 20 is ideal for plywood furniture frames because of its enhanced holding force.

Another important aspect of the furniture spring clip 20 in accordance with the present invention is that the bight portion 34 of the furniture spring clip 20 is formed such that the narrowest opening 52 (FIG. 7) is slightly smaller than the diameter of a furniture spring 38, thus requiring the furniture spring 38 to be forced into the bight portion 34. This causes the short leg portion 30 to flex open slightly to receive the furniture spring 38. After the furniture spring 38 is seated in the bight portion 34, the short leg portion 30 springs back, thus capturing the furniture spring 38 within the furniture spring clip 20, obviating the need for a second staple to capture the spring, such as required in a J-type furniture spring clip. As the short leg portion 30 snaps back after the furniture spring 38 is seated, the furniture spring clip makes a snapping sound which aurally indicates to an operator that the furniture spring 38 is positively locked within the furniture spring clip 20.

The short leg portion 30 of the furniture spring clip 20 is also formed with a lip 54. The lip 54 facilitates placement of the furniture spring 38 into the furniture spring clip 20.

The furniture spring clip 20 in accordance with the present invention is preferably formed from a hardened steel and coated to prevent metal-to-metal contact between the furniture spring 38 and the bight portion 34 of the furniture spring clip 20. In order to facilitate the application of the coating, the entire furniture spring clip 20 may be coated with a polymer-based coating, such as a polyvinyl enamel.

The use of a polymer coating also alleviates problems in manufacturing. More specifically, known furniture spring clips are formed from a continuous sheet and cut into individual strips with a die and subsequently formed into individual furniture spring clips. Prior to cutting into individual strips, an adhesive strip is generally applied to the furniture spring clip. However, the adhesive material can eventually build up on the die and eventually cause problems.

The furniture spring clip 20 in accordance with the present invention is also provided with an guide aperture 56. The guide aperture 56 cooperates with the guide assembly 24 to allow the furniture spring clip 20 to be positioned with respect to the fastener driving tool 22 as will be discussed in detail below.

Another important aspect of the invention relates to the guide assembly 24 for positioning the furniture spring clip 20 with respect to a wooden furniture frame 26 and which also positions the furniture spring clip with respect to the fastener driving tool 22. The guide assembly 24 is disposed adjacent a nosepiece assembly 58 disposed in the front of the tool 22. The nosepiece assembly 58 includes a front nosepiece 60 and a rear nosepiece 62. The front nosepiece 60 is provided with a plurality of apertures 94 which are aligned with apertures 67 in the magazine assembly 64 to allow the front nosepiece 60 to be rigidly attached to the magazine assembly 64 by way of fasteners 69. The rear nosepiece 62 is rigidly attached to a magazine assembly 64 which carries a plurality of fasteners. The magazine assembly 64 is slidably mounted at the bottom of the tool and can be withdrawn to allow fasteners to be replaced. A latch assembly 65 allows the magazine assembly 64 to be latched in a closed position. The magazine assembly 64 also includes a pusher 71 for advancing the fasteners toward a drive track 66 formed by the front nosepiece 60 and the rear nosepiece 62. A driver blade 73 is mounted for reciprocal movement within the drive track 66 to drive a fastener into a workpiece, such as the wooden furniture frame 26. The driver blade 73 is driven by a pneumatic piston 68. The pneumatic piston 68 is controlled by a control valve assembly 70 that is controlled by a trigger 72. The trigger 72 is also interlocked with a guide assembly 24 in accordance with the present invention. The fastener driving tool is described in detail in U.S. Pat. Nos. 3,496,840 and 3,673,922, assigned to the same assignee as the assignee of the present invention and hereby incorporated by reference.

Figure 16:
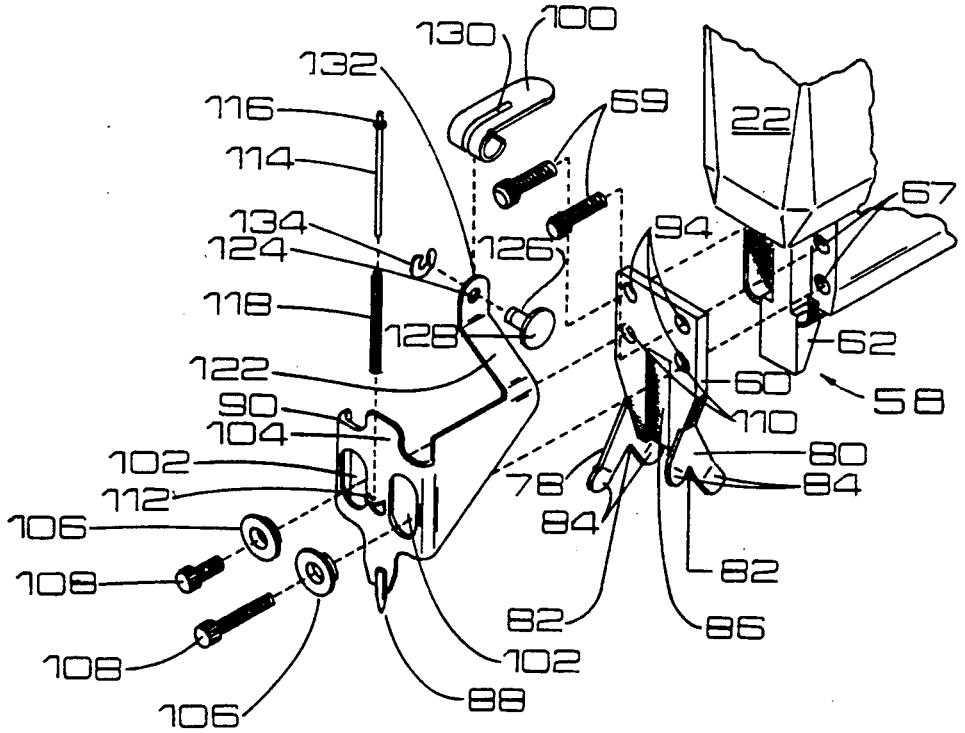
FIG. 16 is a partial, exploded, perspective view illustrating the furniture spring clip guide in accordance with the present invention.

As best shown in FIG. 16, the furniture spring clip guide assembly 24 include a pair of L-shaped guide members 78 and 80 integrally formed in the front nosepiece 60 and disposed on opposing sides of the drive track 66. These guide members 78 and 80 are adapted to position the tool 22 with respect to the furniture frame 26 and also to position the tool 22 with respect to the furniture spring clip 20. The L-shaped guide member 78 and 80 are spaced apart to receive a furniture spring clip 20. The inside corner portions 82 defined by each of the guide members 78 and 80 are adapted to rest on a corner 44 of a wooden furniture frame 26 to position the fastener driving tool 22 with respect to the wooden furniture frame 26.

The L-shaped guide members 78 and 80 are integrally formed with outwardly extending ear portions 84 on each end of the guide members 78 and 80. The outwardly extending ear portions 84 facilitate positioning of the fastener driving tool 22 with respect to the wooden furniture frame 26. Additionally, one or the other of the L-shaped guide members 78 or 80 may be provided with a short leg to allow the operator to see the furniture spring clip 20 before it is secured to the furniture frame 26. One or the other of the L-shaped guide members may be provided with a shortened leg. As shown in the drawings, the L-shaped guide member 80 is provided with a short leg for right-handed operators.

A groove 86 is provided on the front nosepiece 60. The groove 86 acts as a guide for the guide portion 88 of the guide assembly 24. More particularly, the guide portion 88 may be integrally formed with a safety yoke 90 from a rod-like member with a point similar to the shank of a nail. The guide portion 88 is adapted to be received in the aperture 56 in the furniture spring clip 20 when the fastener driving tool 22 is properly positioned on a wooden furniture frame 26. An inside surface 92 of the guide portion 88 may be formed as a key, adapted to ride in the groove 86 as the safety yoke 90 moves up and down with respect to the front nosepiece 60.

A safety yoke 90 cooperates with a control lever 100 which prevents the trigger 72 from engaging the control valve assembly 70 when the safety yoke 90 is not in engagement with a workpiece as shown in FIG. 14. When the safety yoke assembly 90 is in contact with a workpiece as shown in FIG. 15, the control valve assembly 70 will be under the control of the trigger 72.

The safety yoke assembly 98 is formed as an irregular-shaped member having a plate portion 104 with a pair of slots 102. The plate portion 104 is adapted to be slidably mounted with respect to the front nosepiece 60. More particularly, shoulder washers 106 are received in the slots 102 in the plate portion 104. Fasteners 108 are received in apertures 110 in the front nosepiece 60 to slidably attach the safety yoke 90 to the front nosepiece 60 and also position the guide portion 88 between the L-shaped guide members 78 and 80.

The safety yoke 90 is biased downwardly by a spring 118. More specifically, the plate portion 104 of the safety yoke 90 is provided with an outwardly extending flange portion 112 which includes an aperture 113 for receiving one end of a rod 114. The other end of the rod 114 is disposed in an aperture (not shown) in the tool housing. A collar portion 116 of the rod 114 is provided adjacent the end disposed in the tool housing. The collar portion 116 acts as a bearing surface with respect to the housing. A spring 118 is disposed about the rod 114 to bias the safety yoke 90 downwardly. Downward movement of the safety yoke 90 is limited by contact of the shoulder washers 106 with the top of the slots 102. Upward movement of the safety yoke 90 is limited by contact of the shoulder washers 106 with the bottom of the slots 102.

The safety yoke 90 is also formed with an outwardly extending arm portion 122. The arm portion 122 is configured to provide a pivot axis for a control lever 100 disposed adjacent the trigger 72. More specifically, the arm portion 122 is provided with an aperture 124 which defines the pivot axis. The control lever 100, formed as a tongue-shaped member, is curled over at one end for receiving a pin 126 having a head 128 at one end. The pin 126 is received through the aperture 124 in arm portion 122 and through the curled over a portion of the control lever 100. The control lever 100 is formed with a slot 130 for receiving an end portion 132 of the arm portion 122. An appropriate fastener or clip, such as an E-ring 134 is attached to the other end of the pin 126 to secure the pin 126 in place.

Many modifications and variations of the present invention are possible in light of the above teachings. Thus it is to be understood that, within the scope of the appended claims, the invention may be practiced otherwise than as specifically described.

What is claimed and sought to be secured by a Letters Patent of the United States is:

1. A fastener driving tool for securing furniture spring clips to a workpiece including two or more generally substantially perpendicular planar surfaces comprising:

a housing;

a drive assembly disposed in said housing for driving fasteners along a drive track into a workpiece;

a nosepiece assembly forming a drive track, disposed adjacent said drive assembly;

a magazine assembly, mechanically coupled to said nosepiece assembly, for supplying fasteners to said drive track;

actuating means for selectively actuating said drive assembly to drive a fastener into a workpiece; and means for positioning said drive track at a predetermined acute angle with respect to one of said planar surfaces which includes one or more members adapted to engage each of a plurality of substantially perpendicular planar surfaces forming a workpiece, said one or more members extending outwardly relative to said magazine assembly and disposed adjacent to said drive track.

2. A fastener driving tool for securing furniture spring clips having one or more fastener receiving apertures to a wooden furniture frame including two adjacent substantially perpendicular surfaces which define an edge where the planes of the surfaces intersect comprising:

a housing;

a drive assembly disposed in said housing for driving fasteners in a drive track into a workpiece;

a nosepiece assembly defining said drive track, disposed adjacent said drive assembly;

a magazine assembly, mechanically coupled to said nosepiece assembly, for supplying fasteners to said drive track;

a control assembly for actuating said drive assembly;

a trigger for actuating said control assembly;

first means for aligning one or more fastener receiving apertures in said furniture spring clip with respect to said drive track; and second means for engaging each of a plurality of adjacent substantially perpendicular surfaces of a workpiece for positioning said drive track to enable a fastener to be driven through said fastener receiving apertures and into an edge of the workpiece defined by the intersection of the planes of the adjacent surfaces forming the workpiece.

3. A fastener driving tool as recited in claim 1, wherein said first means is integrally formed with said front nosepiece.

4. A fastener driving tool as recited in claim 2, further including a safety yoke reciprocally mounted with respect to said nosepiece assembly and wherein said first means includes a rod like member extending downwardly from said safety yoke.

5. A fastener driving tool as recited in claim 4, further including means for guiding said rod-like member with respect to said nosepiece assembly.

6. A fastener driving tool as recited in claim 5 wherein said guiding means includes a key formed on an inner surface of said safety yoke assembly adjacent said rod-like member and a groove formed in said nosepiece assembly.

7. A fastener driving tool for securing furniture spring clips to a wooden furniture frame comprising:

a housing;

a drive assembly disposed in said housing for driving fasteners in a drive track into a workpiece;

a nosepiece assembly including a front nosepiece and a rear nosepiece forming said drive track, disposed adjacent said drive assembly;

a magazine assembly mechanically coupled to said nosepiece assembly for supplying fasteners to said drive track;

a safety yoke assembly reciprocally mounted with respect to said nosepiece assembly which prevents a control assembly from being actuated when the nosepiece assembly is not in engagement with the workpiece;

a control assembly for actuating said drive assembly;

a trigger for actuating said control assembly;

first means for positioning a furniture spring clip with respect to said drive track;

second means for positioning said nosepiece with respect to a wooden furniture frame including;

third means for positioning the nosepiece assembly with respect to two adjacent generally perpendicular surfaces of the furniture frame, wherein said third mean includes a pair of spaced apart L-shaped members formed from a pair of perpendicular legs disposed adjacent opposite sides of said drive track.

8. A fastener driving tool as recited in claim 7, wherein said L-shaped members are formed with at least one end bent outwardly with respect to said drive track.

9. A fastener driving tool as recited in claim 7, wherein one L-shaped member is formed having one leg relatively shorter than the other leg in said pair of legs.

* * * * *